US006679459B2

(12) United States Patent
Kaiser

(10) Patent No.: US 6,679,459 B2
(45) Date of Patent: Jan. 20, 2004

(54) ELECTRIC OVERHEAD CONVEYER

(75) Inventor: Eugen Kaiser, Rottenburg (DE)

(73) Assignee: Eisenmann Maschinenbau KG (DE)

( * ) Notice: Subject to any disclaimer, the term of this patent is extended or adjusted under 35 U.S.C. 154(b) by 0 days.

(21) Appl. No.: 10/110,808

(22) PCT Filed: Jun. 30, 2001

(86) PCT No.: PCT/EP01/07503

§ 371 (c)(1),
(2), (4) Date: Aug. 26, 2002

(87) PCT Pub. No.: WO02/14133

PCT Pub. Date: Feb. 21, 2002

(65) Prior Publication Data

US 2003/0146069 A1 Aug. 7, 2003

(30) Foreign Application Priority Data

Aug. 16, 2000 (DE) ..... 100 39 946

(51) Int. Cl.[7] ..... B61L 27/00

(52) U.S. Cl. ..... 246/182 C; 246/167 R; 246/182 R; 104/88.03

(58) Field of Search ..... 246/3, 31, 34 B, 246/62, 72, 122 R, 167 R, 182 R, 182 C, 186, 187 R, 167 D; 104/88.01, 88.02, 88.03, 89

(56) References Cited

U.S. PATENT DOCUMENTS

| | | | | | |
|---|---|---|---|---|---|
| 4,361,202 | A | * | 11/1982 | Minovitch | 180/168 |
| 5,437,422 | A | * | 8/1995 | Newman | 246/5 |
| 5,598,783 | A | * | 2/1997 | Lund | 104/88.04 |
| 5,711,388 | A | * | 1/1998 | Davies et al. | 180/168 |
| 5,979,334 | A | * | 11/1999 | Lund | 104/88.04 |
| 6,198,994 | B1 | * | 3/2001 | McCrary | 701/24 |
| 6,276,542 | B1 | * | 8/2001 | McCrary | 213/75 R |
| 6,434,452 | B1 | * | 8/2002 | Gray | 701/19 |
| 2002/0072833 | A1 | * | 6/2002 | Gray | 701/19 |

* cited by examiner

*Primary Examiner*—Mark T. Le
(74) *Attorney, Agent, or Firm*—Factor & Partners

(57) ABSTRACT

The invention relates to an electric overhead conveyer comprising a large number of carriages (8), which circulate on a running rail system (1). Each carriage (8) has an autonomous carriage control (11), whose memory stores (13) all the data for the rail network. The overhead conveyer can either be operated in individual circulation mode, in which each carriage (8) attempts to travel individually at the greatest permissible speed, or in group mode. In group mode, the carriages (8), which are to traverse a common section of the rail network (1) are combined into groups and exchange data concerning the locally permissible speeds that are respectively valid. All the carriages (8) in the group then travel at a speed that corresponds to the lowest permissible speed for all carriages (8) in the group.

4 Claims, 3 Drawing Sheets

ELECTRIC OVERHEAD CONVEYER

The invention concerns an electric suspension conveyor with a) a running rail system forming a line network;

b) a plurality of carriages, each having:

ba) at least one travelling mechanism which runs in the running rail system;

bb) at least one load carrier which hangs down from the travelling mechanism;

bc) at least one drive motor;

bd) an autonomous carriage control which, in turn, comprises:

bda) a processor;

bdb) a memory in which can be stored the entire line network and the maximum permissible speed at each location of the line network and the minimum permissible distance from the preceding carriage;

bdc) a controller, driven by the processor, which energizes the drive motor;

c) a central control which assigns the travel tasks to the individual carriages and clears the travel paths in the line network;

d) a code rail system which extends along the line network and carries a code, which can be read out by each carriage, for the position at which the respective carriage is located;

e) a databus rail system which extends along the line network and via which the carriages communicate with one another and with the central control, f) the carriage control of each carriage requesting from the code rail system, during travel, the respective location of the carriage, obtaining from the memory the maximum speed for this location of the line network and, in the absence of other information, attempting to bring the carriage to the maximum speed.

In known electric suspension conveyors of this type, the autonomous carriage control of each carriage in the entire system attempted to bring the carriage to the maximum speed permissible at the respective position at which the carriage is located. The movement of several carriages in the line network was correlated in that a minimum distance from a preceding carriage was predefined and each respectively following carriage reduced its speed so that this minimum distance could be maintained. Otherwise, the individual carriages moved freely and independently of one another in the line network, according to the commands of the central control.

In the case of this type of operation of the electric suspension conveyor, it was necessary for relatively large safety distances to be maintained between the individual carriages. This means substantial losses of capacity in cases where high travel speeds are sought for the carriages.

The object of the present invention is to develop an electric suspension conveyor of the initially stated type in such a way that its capacity is increased.

This object is achieved, according to the invention, in that g) the central control either operates each carriage in an individual travel mode or, in a group mode, combines several carriages, traversing certain distances of the line network one behind the other, to form groups in which all carriages have essentially the same speed, and can transmit information on the membership of the group to the individual carriages;

h) the carriage control of each carriage in group mode respectively requests from the code rail system, during travel, the respective location of the carriage, exchanges information, via the databus rail system, on the instantaneously permissible speed of each carriage in the group, and drives the drive motor of the corresponding carriage so that the carriage travels at the lowest permissible speed of all carriages in the group.

Thus, according to the invention, carriages which are intended to traverse certain sections of the line network together and one behind the other are combined to form so-called "groups". A group is characterized in that all carriages belonging to it move at the same speed. However, the maintenance of this speed by each carriage is not the result of control processes and distance measurements, which would occupy an excessively long period of time. Instead, each carriage is informed, via the databus system, by all other carriages in the group which maximum permissible speed must be maintained by the other carriages of the group. If even only one carriage in the group signals that at its location it is necessary to maintain a speed which is lower than the hitherto commonly travelled speed, then it is not only that carriage which reduces its speed to the lower permissible value but, rather, all other carriages in the group follow it without a time delay and, in so doing, override the higher speed value that is actually permissible according to the position at which they are located. This adaptation of the speeds of all carriages in the group to the respectively lowest permissible speed, without any appreciable time delay, increases the operational safety.

The greater rapidity in the adaptation of the speeds of the carriages in the group to the uniform, lowest permissible speed enables the minimum permissible distance between the carriages which are operated in group mode to be less than the minimum permissible distance between the carriages which are operated in individual travel mode. Parameters being otherwise the same, a lesser minimum distance between the carriages means an increased conveying capacity.

Alternatively, or additionally, it is possible, in the case of the present invention, for the local permissible speed to be higher for each carriage which is operated in group mode, at least in regions of the line network, than for the carriages which are operated in individual travel mode. Again, parameters being otherwise the same, this means an increased conveying capacity of the overall system.

In a further advantageous development of the invention, each carriage has a distance sensor which ascertains the distance from the preceding carriage and emits a signal to the respective carriage control if a certain minimum distance is not maintained. This distance sensor performs a safety function only, since it has to operate only if the autonomous control of the carriages via the code rail system and the databus rail system should fail for any reason.

BRIEF DESCRIPTION OF THE DRAWINGS

An embodiment example of the invention is explained more fully below with reference to the drawing, wherein.

DETAILED DESCRIPTION OF THE DRAWINGS

Figure 1:
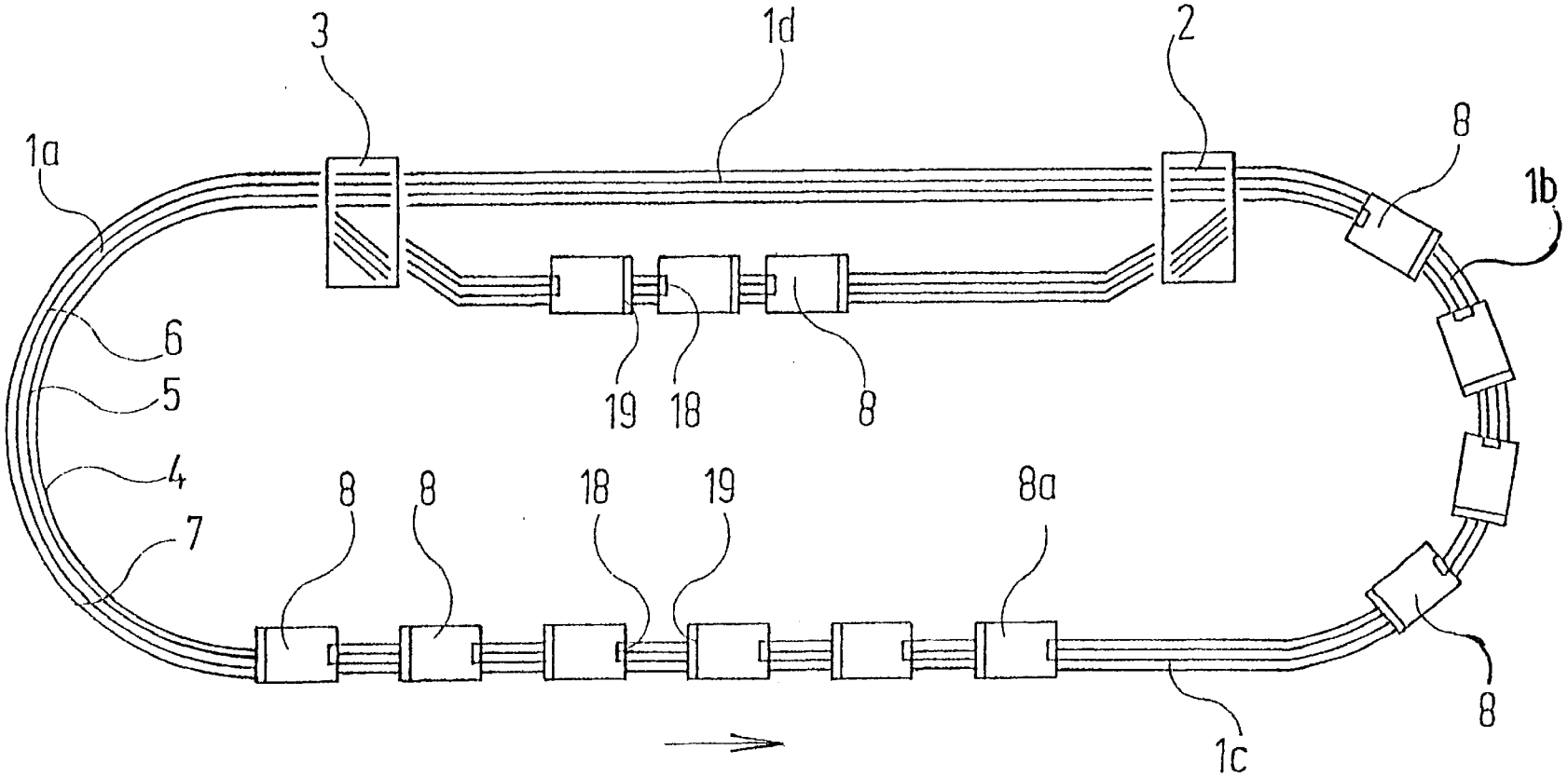
FIG. 1: shows, in schematic form, a very simple line plan of an electric suspension conveyor.

FIG. 1 shows a top view of a very simple line plan of an electric suspension conveyor. It comprises two semicircular sections 1*a*, 1*b*, which are joined together by two rectilinear sections 1*c*, 1*d*, thus forming an oval. Extending in parallel to the rectilinear line section 1*d* is a rectilinear secondary line section 1*e*, which is joined to the main line network via the points 2, 3. The course of the line is represented in FIG. 1 by the following four rails, which extend in parallel: a running rail 4, a conductor rail 5, a databus rail 6 and a code rail 7.

The travelling mechanisms of the individual carriages 8 of the suspension conveyor, which have a suspension gear which extends downwards from the travelling mechanisms and attached to it, if applicable, a load carrier, run in the running rail 4 in a known manner. Each carriage 8 has its own drive motor, and a carriage control which enables the respective carriage 8 to search for and find its path on the line network 1, under the control of an internally stored program and external commands, in correlation with the other carriages 8 travelling on it.

Figure 2:
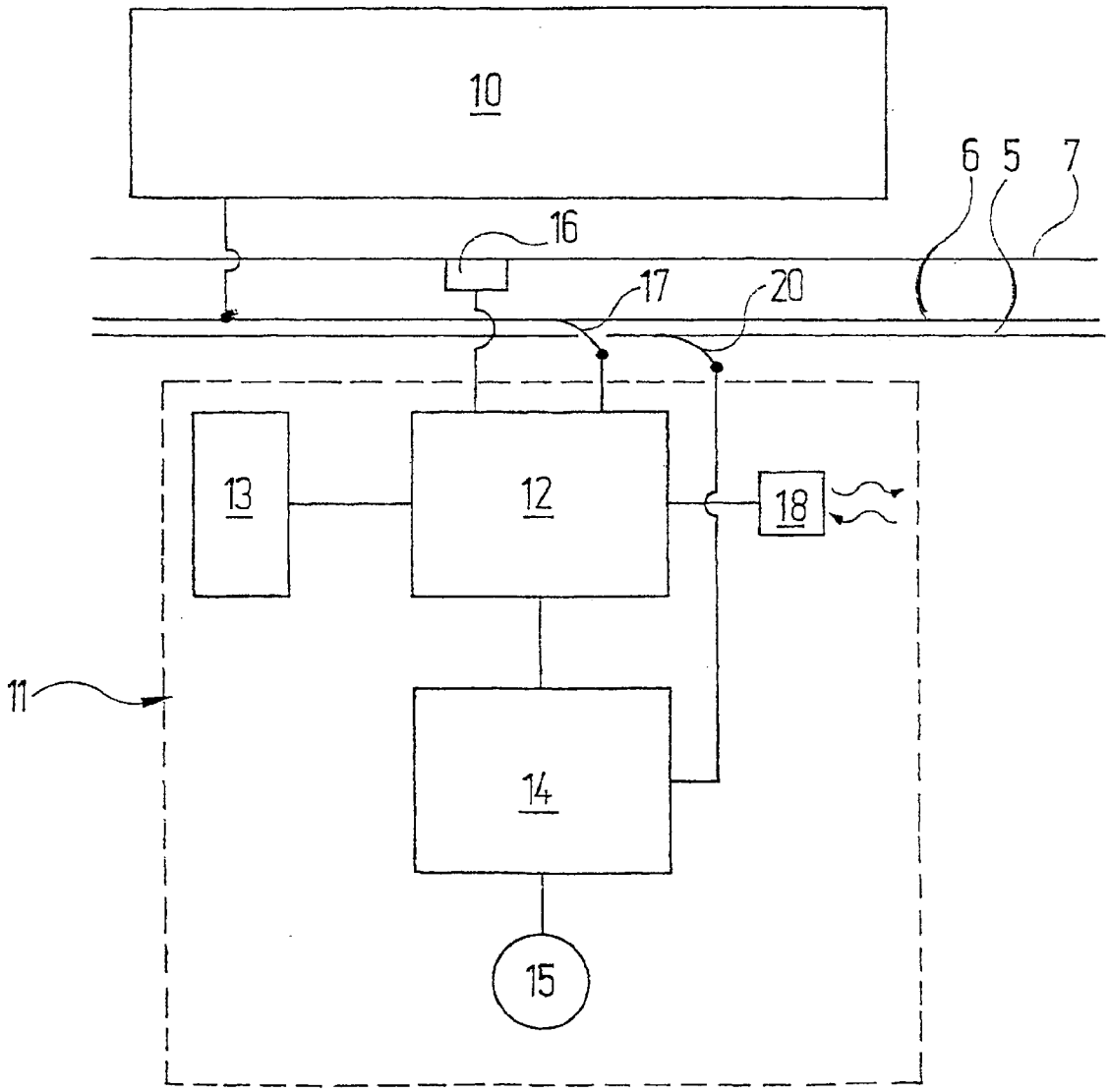
FIG. 2: shows the block diagram of the control of a carriage of the electric suspension conveyor interacting with a central control.

How this is achieved by the interaction between the control 11 of the individual carriages 8 and a central control 10 is explained below with reference to the block diagram shown in FIG. 2. In the case of more complicated line plans, as explained further below with reference to FIG. 3, the central control 10 is of a hierarchical structure and connected to the databus rail 6.

The autonomous control 11 belonging to each carriage comprises a processor 12, a memory 13 and a controller 14 which acts on the drive motor 15 of the carriage 8.

Data is supplied to the processor 12 from a read head 16 which is guided along the code rail 7 and which obtains from the latter, with an accuracy of better than 1 mm, information on the respective location of the carriage 8. The processor 12 additionally exchanges data bidirectionally with the databus rail 6, via a sliding contact device 17. It is also connected to the memory 13 and a distance sensor 18 which is disposed on the front end of the respective carriage 8, as viewed in the direction of motion, and operates together with a reflector 19 on the respectively rear end of the preceding carriage 8 (cf. FIG. 1). The processor 12 drives the controller 14 which, in turn, is connected to the conductor rail 5 via a sliding contact device 19 and energizes the drive motor 15 according to these signals.

The entire line network 1, including all so-called "special positions", is stored in the memory 13. "Special positions" are all positions in the line network for the passage of which the carriage 8 requires a clearance signal from the central control 10. In particular, the special positions are points, such as the points 2, 3 of FIG. 1, fire protection gates, lifting devices, etc. The memory 13 also contains information, in tabular form, on the maximum speed that is permissible at each position of the line network 1 and on the minimum permissible distance from the preceding carriage 8, which can be specified as a function of the instantaneous speed.

The described control operates as follows:

Each carriage 8 under consideration receives from the central control 10, via the databus 6 and the sliding contact device 17, a travel task which indicates to it the destination of the respective journey. The processor 12 drives the controller 14 in such a way that the latter energizes the drive motor 15 of the respective carriage 8 so that, in the absence of commands to the contrary, the maximum permissible speed is travelled at each position of the line network 1. For this purpose, the read head 16 reads from the code rail 7 the respective position at which the carriage 8 is instantaneously located. From the table stored in the memory 13, the processor 12 obtains the maximum speed that is permissible at the respective location and, via the controller 14, drives the motor 15 accordingly. It additionally calculates a setpoint position of the carriage 8 from the time integral of the setpoint speeds, compares this setpoint position with the actual position, which is read from the code rail 6 by means of the read head 16, and sends to the controller 14 corresponding correction commands by means of which deviations between an actual and a setpoint position of the carriage 8 are eliminated. Such deviations can result from disturbance variables which affect the mechanics of the carriage, e.g. from an incline, the load or friction.

The central control 10 continuously receives information from the carriage control 11, via the databus rail 6, on the position at which each carriage 8 is instantaneously located. In good time before a special position, e.g. one of the points 2, 3 in FIG. 1, is reached, the central computer 10 sets the respective device at the special position, e.g. the points 2, 3, in such a way that the respective carriage 8 can reach its destination in the line network 1. If passage of the carriage 8 through the special position is enabled, e.g. through a corresponding response of the point 2 or 3, the central control 10 sends a corresponding clearance command to the carriage control 11. This results in the carriage 8 passing the corresponding special position without stoppage; if the clearance command is not given by the central control 10, however, the carriage 8 brakes at a distance before the special position which is calculated as a necessary braking distance for the respective speed, and comes to a halt at the special position.

If only one single carriage 8 were to move on the entire line network 1, the interaction between the central control 10 and the carriage control 11 would be thus described: the carriage 8 would pass through from its starting point to its specified destination, at a speed corresponding to the maximum speed, stored in the memory 13, for each location in the line network 1, only the passage of the carriage 8 through the special positions being monitored by the central computer 10.

In actual fact, however, there is a multiplicity of carriages 8 moving on the line network 1, all of which are equipped with the same type of carriage control 11. All of these carriages 8 are connected, via the databus rail 6, not only to the central computer 10 but also to each other, so that each carriage 8 in the line network 1 is informed of the position of each further carriage 8 in the same line network 1.

There are basically two different modes of operation to be distinguished in the movement of several carriages 8 on the line network 1: individual travel, in which, except for collision avoidance, the individual carriages 8 are essentially guided from the starting point to the destination point in the manner described above, and in a group mode, in which several carriages 8 are combined to form a group and are guided in this group over a certain distance of the line network 1 at an essentially uniform speed.

As already mentioned, the individual travel mode corresponds largely to the autonomous travel, described above, of the individual carriage 8 from the starting point to the destination point. However, if the carriage control 11 of a carriage 8 under consideration receives the information, via the databus rail 6, that the distance from the preceding carriage 8 has fallen below the minimum, stored in the memory 13, which corresponds to the respective speed, the processor 12 drives the motor 15, via the controller 14, so that the speed drops below the maximum permissible value and the necessary safety distance from the preceding carriage 8 is maintained. This travel status is then maintained until the preceding carriage 8 is no longer detected within the minimum distance, for example, when the latter has travelled into a branch section of the line network 1. The carriage control 11 then accelerates the carriage 8 under consideration back to the maximum speed that is permissible, according to the table value stored in the memory 13, at the respective location of the line network 1 read from the code rail 7 by the read head 16.

If several carriages 8 in the line network 1 traverse certain line sections together and one behind the other, it is expedient, for capacity reasons, to combine them to form a group. The carriages 8 of a group all travel at the same speed and vary the speed in exact temporal correlation. It is thus possible for the carriages 8 of the group to travel at a minimum distance from one another which is less than the minimum distance in the case of individual travel. The value of this (lesser) minimum distance from the preceding carriage 8 is also stored in the memory 13 in each carriage 8.

The central computer 10 determines which successive carriages 8 are combined to form a group and at which position in the group the respective carriage 8 is located. The control of the carriages 8 is now modified, by comparison with the control in the individual travel mode described above, in the following manner:

Firstly, as a determinative distance from the respective preceding carriage 8, the lesser value is read out, as the relevant value, from the memory 13. This enables the individual carriages 8 to move closer to one another than would be possible in the case of individual travel. Secondly, rather than all the carriages 8 in the group varying their speed upon reaching one and the same certain location in the line network 1, at which a speed variation is to be effected according to the table stored in the memory 13, each carriage 8 in the group determines its speed according to the lowest speed at which a carriage 8 in the group may travel.

This process is to be described more fully with reference to the line network 1 represented in FIG. 1:

To be considered are the carriages 8 in group travel mode in the lower rectilinear section 1*c* of the line network 1, which are moving in the direction of the arrow. In the rectilinear line section 1*c* the carriages 8 can move at a higher speed, the value of which can be read from the table contained in the memories 13. If the first carriage 8*a* of the group now moves into the semicircular line section 1*b*, in which a lesser maximum speed is applicable, this carriage 8*a* reduces its speed to this lesser value, in a manner similar to that of individual travel. All succeeding carriages of this group also reduce their speed accordingly, in correlation with it. This does not occur as a result of the succeeding carriages 8 drawing too close to the respective preceding carriage 8 and the individual carriage controls 11 adjusting the respective carriage speed downwards upon detection of the excessive closeness; this operation would require too much time. Instead, the first carriage 8*a* in the group signals to all other carriages 8 in the group, via the databus rail 6, that its permissible speed is reduced. All other carriages 8 of this group react to this with a corresponding speed reduction, even if they are still located in the rectilinear line section 1*c*, in which a higher speed would be permissible. In this way, the speed of all carriages 8 in the group is varied in exact temporal correlation.

The carriages 8 of the group then successively traverse the semicircular section 1*b* of the line network 1 at a reduced speed.

It is to be assumed that the point 2 is set so that the group under consideration travels into the rectilinear line section 1*d*, where a higher maximum speed is again allowed. Each carriage 8 approaching the point 2 obtains a clearance command from the central control 10, so that the carriage 8 passes the point 2. The leading carriage 8*a* of a group does not then accelerate, analogously to the braking operation described above, as soon as it travels into a line region of the line network 1 in which, according to the table stored in the memory 13, it would be permitted to travel at a higher speed. Instead, in this case it waits until the last carriage 8*b* of the group has likewise travelled into the rectilinear line section 1*d* and all carriages of the group now signal, via the databus rail 6, that they may travel at the higher speed permitted on the rectilinear line section 1*d*. The leading carriage 8*a* thus accelerates in exact temporal correlation with all other carriages 8 of the group, including the last carriage 8*b*, to the higher speed that is now permissible.

If the minimum distance between the carriages 8 in the group is non-dependent on speed, the above-mentioned term "temporal correlation" means an exact simultaneity.

Again for reasons of capacity of the overall system, it can be expedient to make the distance between the carriage 8 in the group speed-dependent: thus, for instance, the distance between the carriages 8 in the semicircular region 1*b*, in which a lesser maximum speed is permissible, can be made smaller than the distance between the carriages 8 in the rectilinear line section 1*c*, where a greater maximum speed is permissible. The reduction of the distance in regions in which travel is slower can be achieved as a result of the individual carriages 8 of the group calculating the location at which they reduce their speed on the basis of this reduced distance. In this case, therefore, the reduction of the speed of all carriages in the group is no longer effected simultaneously, but in a certain time sequence, but still without control-determined delay, since each carriage autonomously varies the braking operation solely on the basis of its own control 11 upon reaching a location read from the code rail 7 by its own read head 16. Analogously, following traversing of the line section 1*b*, which permits only a lesser maximum speed and, consequently, a smaller distance between the carriages 8, the greater distance between the carriages 8 is restored on the line section 1*d*, which again allows a higher speed. For this purpose, the individual carriages 8 in the group calculate the positions at which they are to increase their speed on the basis of their position in the group and of the new, greater distances between the carriages 8. Again, the individual carriages 8 in the group do not vary their speed simultaneously, but in a time-staggered manner, but without control-determined time lags.

Figure 3:
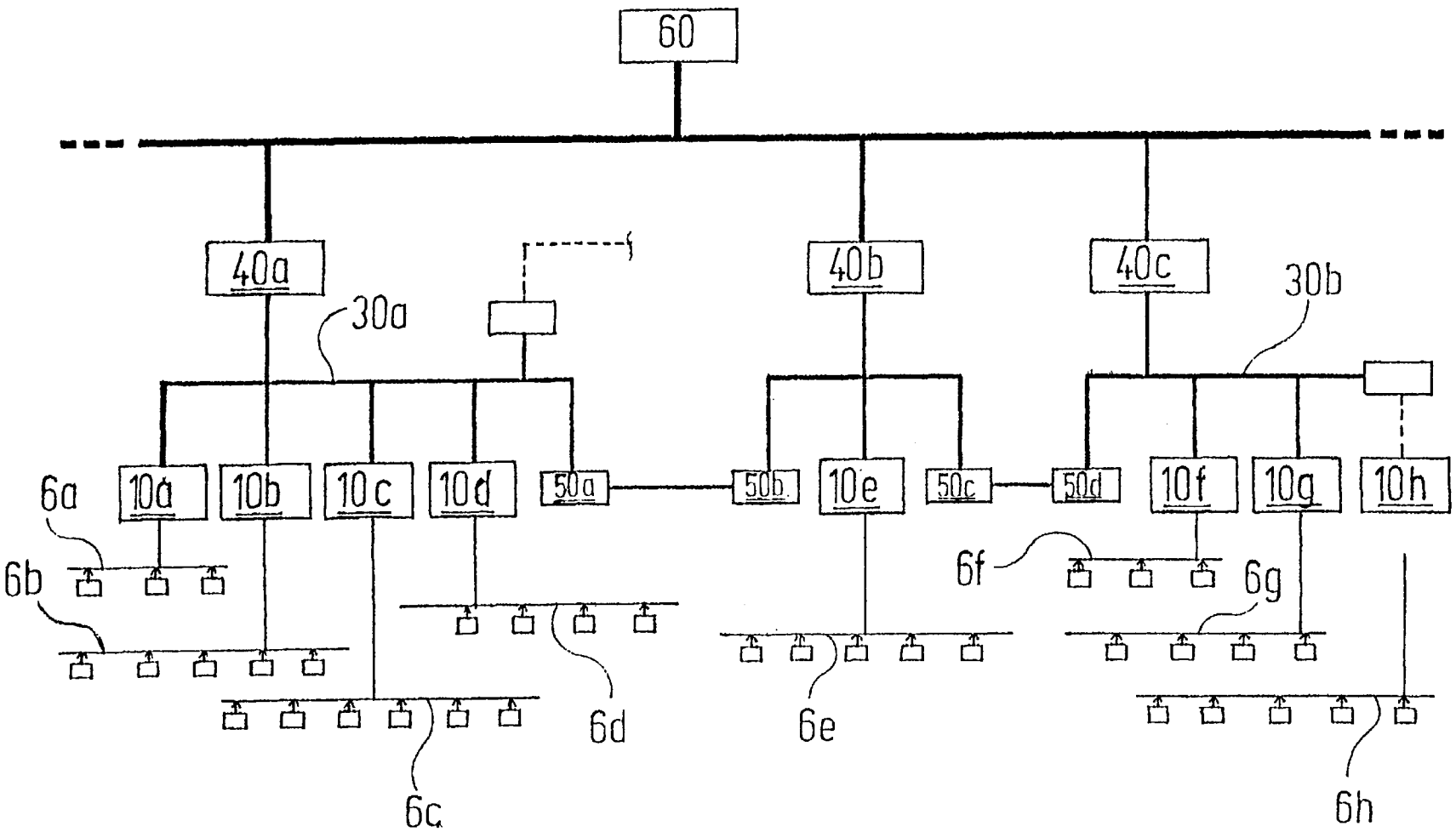
FIG. 3: shows, in schematic form, the block diagram of central control divided into several hierarchy levels.

FIG. 3 represents, in block diagram form, how the central control 10 is divided into different hierarchical levels in the case of a more complicated line network 1. The entire line network 1 is divided into different segments, a databus line section 6*a* to 6*h* corresponding to each respectively.

The carriages 8, which are located on the individual line network segments and are respectively connected to a section 6*a*–6*h* of the databus rail 6, are respectively controlled by segment controls 10*a*–10*h*. Several segment controls 10*a*–10*h*, which can be assigned to common geometric regions of the line network 1, are connected to a regional controller (CEDIO) 40*a*, 40*b*, 40*c* via a high-speed CAN bus 30*a*, 30*b*. Special coupling CPUs 50*a*–50*d*, which effect a continuous connection of the segment controls 10*a*–10*h* over the entire system, are installed at regional boundaries to bridge the greater distances that exist in those cases. These coupling CPUs 50*a*–50*d* convert the baud rate to render possible a connection over greater distances between the individual regions.

The regional controllers 40*a*, 40*b*, 40*c*, in turn, are connected to the central system programmable controller 60.

The above description of the functioning of the control of the individual carriages 8 on the line network 1 of the electric suspension conveyor has not yet considered the function of the distance sensor 18. Ideally, the latter is not necessary per se for the operation of the electric suspension conveyor, and constitutes a safety measure only. The distance sensor 18 measures, in addition to the information, communicated via the databus rail 6, on the location of the preceding carriage 8, the distance from this preceding carriage 8 in the manner of a reflection light barrier. Normally, the distance sensor 18 does not need to be active, since the processor 12 of each carriage control 11 already provides for the correct distance from the preceding carriage 8 on the basis of the measured actual position of the respective carriage 8 and the position of the preceding carriage 8, communicated via the databus rail 6. If, however, this control operation should fail for any reason, the distance sensor 18 ensures, through a corresponding signal acting on the processor 12, that the carriage 8 comes to a standstill.

What is claimed is:

1. Electric suspension conveyor comprising:

a) a running rail system forming a line network;

b) a plurality of carriages, each having:

ba) at least one travelling mechanism which runs in the running rail system;

bb) at least one drive motor;

bc) an autonomous carriage control which, in turn, comprises:

bca) a processor;

bcb) a memory in which can be stored the entire line network and the maximum permissible speed at each location of the line network and the minimum permissible distance from the preceding carriage;

bcc) a controller, driven by the processor, which energizes the drive motor;

c) a central control which assigns travel tasks to individual carriages and clears travel paths in the line network;

d) a code rail system which extends along the line network and carries a code, which can be read out by each carriage, for the position at which the respective carriage is located;

e) a databus rail system which extends along the line network and via which the carriages communicate with one another and with the central control, f) the carriage control of each carriage requesting from the code rail system, during travel, the respective location of the carriage, obtaining from the memory the maximum speed for this location of the line network and, in the absence of other information, attempting to bring the carriage to the maximum speed, characterized in that g) the central control either operates each carriage in an individual travel mode or, in a group mode, combines several carriages, traversing certain distances of the line network one behind the other, to form groups in which all carriages have essentially the same speed, and can transmit information on the membership of the group to the individual carriages;

h) the carriage control of each carriage in group mode respectively requests from the code rail system, during travel, the respective location of the carriage, exchanges information, via the databus rail system, on the instantaneously permissible speed in each carriage in the group, and drives the drive motor of the corresponding carriage so that the carriage travels at the lowest permissible speed of all carriages in the group.

2. Electric suspension conveyor according to claim 1, characterized in that the minimum permissible distance between the carriages which are operated in group mode is less than the minimum permissible distance between the carriages which are operated in individual travel mode.

3. Electric suspension conveyor according to claim 1, characterized in that the local permissible speed is higher for each carriage which is operated in group mode, at least in regions of the line network, than for the carriages which are operated in individual travel mode.

4. Electric suspension conveyor according to claim 1, characterized in that each carriage has a distance sensor which ascertains the distance from the preceding carriage and emits a signal to the respective carriage control if a certain minimum distance is not maintained.

* * * * *